US006964182B2

(12) United States Patent
Karakawa et al.

(10) Patent No.: US 6,964,182 B2
(45) Date of Patent: Nov. 15, 2005

(54) TREATMENT APPARATUS FOR CHEMICAL MODIFICATION OF ANIMAL FIBERS OF CONTINUOUS WEB FORM

(75) Inventors: Tadashi Karakawa, Haguri-gun (JP); Ryo Umehara, Haguri-gun (JP); Hisashi Ichimura, Haguri-gun (JP); Masataka Oshima, Settsu (JP); Kazuyoshi Sakoda, Settsu (JP)

(73) Assignees: Kurabo Industries Ltd., Okayaka-Ken (JP); Nagoya Oshima Machinery Co., Ltd., Aichi (JP)

( * ) Notice: Subject to any disclaimer, the term of this patent is extended or adjusted under 35 U.S.C. 154(b) by 386 days.

(21) Appl. No.: 10/394,216

(22) Filed: Mar. 24, 2003

(65) Prior Publication Data

US 2003/0182977 A1 Oct. 2, 2003

(30) Foreign Application Priority Data

Mar. 29, 2002 (JP) ..... 2002-095843

(51) Int. Cl.[7] ..... C14B 1/00
(52) U.S. Cl. ..... 69/1; 69/27; 69/28
(58) Field of Search ..... 69/1, 23, 27, 28, 69/22; 8/94.1 R, 94.12, 94.13, 94.14, 94.15, 8/94.19 R, 94.2; 68/5 C, 5 D, 5 R, 6–8

(56) References Cited

U.S. PATENT DOCUMENTS

| | | | | |
|---|---|---|---|---|
| 3,149,906 A | * | 9/1964 | Thorsen | 8/128.1 |
| 3,457,213 A | * | 7/1969 | Manos | 524/372 |
| 3,632,299 A | * | 1/1972 | Thorsen | 8/128.1 |
| 4,189,303 A | * | 2/1980 | Thorsen | 8/115.7 |
| 4,261,188 A | | 4/1981 | Mains | |
| 4,300,367 A | * | 11/1981 | Thorsen | 68/5 D |
| 4,377,388 A | | 3/1983 | Mains | |

FOREIGN PATENT DOCUMENTS

| | | |
|---|---|---|
| CN | 1335425 | 2/2002 |
| DE | 1 460 353 | 4/1969 |
| EP | 1 176 245 | 1/2002 |
| GB | 1002097 | 8/1965 |
| GB | 1200086 | 7/1970 |

(Continued)

OTHER PUBLICATIONS

"Continuous Shrink-Resist Process of Wool Top Silver With Ozone I Performance", Tadashi Karakawa et al, published in "Sen'I Gakkaishi" 2002, vol. 58-4, issued on Apr. 10, 2002 (English Abstract and partial translation).

*Primary Examiner*—Gary L. Welch
(74) *Attorney, Agent, or Firm*—Wenderoth, Lind & Ponack, L.L.P.

(57) ABSTRACT

A mechanism, giving less environmental load, for treating animal fibers of a continuous web form so as not to spoil inherent properties of the animal fibers such as hand-feeling and water repellency, so as to improve resistance to felting (shrinkage) and pilling. The mechanism includes: a tank filled with a treatment liquid; a net-conveyor having upper and lower mesh belts put one upon the other to sandwich the continuous web form therebetween for conveying the web form through the liquid of the tank; a treating-liquid circulation system including a gas-liquid mixing pump connected to a suction-port in the tank and pumping out the liquid, a static mixer connected downstream of the pump, and a discharge nozzle placed at a position in the tank facing the suction-port with the mesh belts therebetween, the discharge nozzle being connected downstream of the mixer; and an ozonizer for supplying ozone gas into the system.

7 Claims, 9 Drawing Sheets

FOREIGN PATENT DOCUMENTS

| | | |
|---|---|---|
| JP | 50-126997 | 10/1975 |
| JP | 59-40395 | 3/1984 |
| JP | 59-123191 | 8/1984 |
| JP | 3-019961 | 1/1991 |
| JP | 8-246329 | 9/1996 |
| JP | 10-072762 | 3/1998 |
| JP | 11-315467 | 11/1999 |
| JP | 2001-164430 | 6/2001 |
| JP | 2001-164460 | 6/2001 |
| WO | 96/05350 | 2/1996 |

* cited by examiner

TREATMENT APPARATUS FOR CHEMICAL MODIFICATION OF ANIMAL FIBERS OF CONTINUOUS WEB FORM

BACKGROUND OF THE INVENTION

1. Field of the Invention

The present invention relates to a treatment apparatus for chemical modification of animal fibers of a continuous web form, and particularly relates to the treatment apparatus for improving the property to prevent felting shrinkage of the animal fibers and for improving the resistance to pilling.

2. Description of the Related Arts

Animal fibers have a characteristic hand-feeling as textile fibers employed for clothes, and they are excellent in absorption/desorption of moisture, in water retaining property, and in heat retaining property. They also have a particular nature of water repellency, have moderate tensile strength, moderate elastic property and moderate resistance against abrasion or against wear. In addition, they have biodegradability. However, the animal fibers have, in general, week property in the resistance to pilling thereof, and the pilling nature is not preferable as that of fibers employed for clothes. Therefore, surface modification, and improvement of such fibers, have been long studied and researched, mainly from the aspect of shrink-resistant treatment. As part of the studies and researches, the pilling-resistant treatment (or treatment for preventing the formation of the pilling) has also been sought. However, employing such a conventional treatment or process, the water repellency as an inherent nature of the animal fibers are spoiled more or less.

The conventional method for the surface modification of the animal fibers includes the step of softening or removing the scales which are epidermal structures of the animal fibers, using chlorinating agents or oxidizing agents, for the purpose of performing the shrink-resistant treatment. However, the use of the chlorinating agent may possibly cause a social environmental problem in the future from the view point of the effluent regulation of the Absorbable Organic Halides (AOX). In addition, the treatment, or process, employing the chlorinating agents or the oxidizing agents, leads to such disadvantages as spoil of the hand-feeling to the animal fibers and/or impairment of the water repellency thereof. Moreover, the treatment leads to the reduction of the tensile strength of the animal fibers and the reduction of resistance against abrasion thereof.

Japanese Laid-Open Patent Publication No. 50-126997 discloses a method for improving the dye-affinity and shrink-resistance of wool and for improving the pilling resistance of wool-synthetic blend products, without deteriorating the hand-feeling and tensile strength of the wool. In the disclosed method, the wool impregnated with an aqueous solution of an acid or an acid salt, is brought into contact with an ozone-containing gas. This method, however, has the following problems. That is, the system for performing the method must be a closed system (or a sealed system), because the method involves treatment in an ozone gas atmosphere. According to the method, the water-impregnated wool fibers react with the gaseous ozone. Therefore, the unevenness at which location the wool fibers are impregnated with water, and/or the unevenness at which location the wool fibers are exposed to the gaseous ozone, directly cause(s) the unevenness treatment, thus deteriorating uniformity of the treatment. Moreover, since the treatment or process is carried out in the closed system, the productivity is low. Also, because the environmental loads, such as leakage of ozone from a treating machine (or processing machine) and deterioration in work environment, are great, industrialization employing this method is difficult.

On the other hand, Japanese Laid-Open Patent Publication No. 3-19961 discloses a shrink-resistant treatment method for processing animal fibers, employing ozone as an oxidizing agent. The publication describes that animal fibers in water is brought into contact with fine bubbles of ozone. However, the ozone gas bubbles formed or generated by the glass filter, are too large to be allowed to go into minute portions of a group of the fibers of the animal. Actually, the bubbles can process or treat only the surface portion of the group of the fibers thereof. This results in forming the unevenness treatment thereon, and it fails to provide sufficient shrink resistance to the fibers. As the amount of treatment of the animal fibers increases, more unevenness treatment are formed. In order to enable ozone gas bubbles to go into minute portions of a group of the animal fibers, the size of the gas bubbles must be smaller than the fineness (i.e. the diameter) of the animal fibers to be treated. In addition, the disclosed agitation at 30° C. for 30 minutes is insufficient.

To solve the above problem, Japanese Laid-Open Patent Publication No. 2001-164430 discloses an ozone treatment method. According to the method, in order to enable ozone gas bubbles to go into minute portions of a group of fibers, an aqueous treatment liquid containing gaseous ozone as superfine bubbles having a size of 10 microns or less is blown to the fibers. FIG. 1 shown in the same publication illustrates an apparatus in continuous system for modification of the animal fibers, employing the method. However, the apparatus illustrated on the aforementioned No. 2001-164430 is constructed in a batch system for ozone treatment of a fabric which is fixed to a fixing frame, and it is not constructed for ozone treatment of a continuous fiber structure. Moreover, this apparatus finds difficulty in treating fabric uniformly, or evenly, with the ozone gas in the direction of thickness of the fabric.

SUMMARY OF THE INVENTION

It is an object of the present invention to provide a treatment apparatus for modifying animal fibers of a continuous web form, in which the nature or property to prevent shrink (or shrinkage) of the animal fibers and the nature or property to prevent the animal fibers from pilling are improved or enhanced, in which the hand-feeling unique to the animal hair fibers and the water repellency thereof are not spoiled, and in which the load to the environment is significantly reduced.

In accomplishing this and other objects of the present invention, there is provided a treatment apparatus for chemical modification of animal fibers of a continuous web form, comprising: a tank filled with an aqueous treatment liquid; a net coveyor which has a pair of mesh belts composed of an upper mesh belt and a lower mesh belt and which conveys the continuous web form (or continuous web-like form) through the aqueous treatment liquid in the tank, with the pair of mesh belts overlapping each other in a state in which the pair of mesh belts sandwich the continuous web form therebetween for holding the continuous web form; a treatment liquid circulation system having: a gas-liquid mixing pump which includes an inlet connected to a suction port provided in the tank and which includes an outlet for supplying the aqueous treatment liquid into the tank; a static mixer which is connected downstream of the outlet of the gas-liquid mixing pump; and a discharge nozzle which is provided opposite the suction port in the tank with respect to the pair of mesh belts, in which the discharge nozzle is connected downstream of the static mixer; and an ozonizer for supplying ozone gas to the treatment liquid circulation system, wherein the continuous web form of the animal fibers (or the animal fibers of the continuous web form) is(are) continuously treated with the ozone gas, by mixing the aqueous treatment liquid supplied from the gas-liquid mixing pump with the ozone gas supplied from the ozonizer by the static mixer into dispersing the ozone gas as fine gas bubbles thereof in the aqueous treatment liquid uniformly, by discharging the aqueous treatment liquid containing the fine gas bubbles thereof toward the pair of mesh belts from the discharge nozzle, and by sucking the aqueous treatment liquid containing the fine gas bubbles thereof from the suction port.

As the animal fibers, for example, there are wool, mohair, alpaca, cashmere, llama, vicuna, camel hair and Angora, and the continuous form of such animal fibers includes fabrics and slivers which are produced from animal fibers or produced from a blend of animal fibers and other fibers such as synthetic fibers, by a weaving method, a sewing method or a non-woven fabric manufacturing method. The pair of mesh belts of the net conveyor are overlapped one upon the other, at least inside the tank. As an embodiment, the pair of mesh belts can sandwich the continuous web form of animal fibers therebetween at an entrance to the treatment apparatus at the time of supplying the continuous web form thereof thereinto, and the pair of mesh belts can be separated from each other at an exit therefrom in order to release the continuous web form thereof therefrom at the time of getting the continuous web form thereof out of the treatment apparatus.

According to the construction, the treatment liquid circulation system has both of the discharge nozzle and the suction port in the tank, thereby circulating part of the aqueous treatment liquid in the tank. With the construction, the aqueous treatment liquid including the fine ozone gas bubbles dispersed uniformly or evenly therein, is discharged from the discharge nozzle; and at the same time, the aqueous treatment liquid including the fine ozone gas bubbles thereof are sucked from (or by) the suction port.

The static mixer of the treatment liquid circulation system operates to disperse the ozone gas supplied from the ozonizer in the aqueous treatment liquid which is pumped out from the gas-liquid mixing pump as fine gas bubbles. The position or location at which the ozone gas is supplied into the treatment liquid circulation system, is, preferably, somewhere between the suction port and the gas-liquid mixing pump.

As the ozone gas, any ozone-containing gas can be employed as it is, which is produced from oxygen as a material by changing part of the oxygen, with a silently electric discharging method (or silent discharge method), with a method of photochemistry (or photochemical method), with a plasma discharging method, or the like. Incidentally, when a terminology of "ozone" is referred to hereinafter, the terminology also means a gas containing the ozone.

The aqueous treatment liquid containing the fine ozone gas bubbles dispersed uniformly therein by the static mixer, can be discharged toward one side of the pair of mesh belts from the discharge nozzle; and the continuous web form of animal hair fibers sandwiched between the pair of mesh belts reacts with the ozone gas chemically. Then, due to the power to suck the aqueous treatment liquid by the suction port which can be arranged opposite the discharge nozzle with respect to the mesh belts, the fine ozone gas bubbles dispersed in the aqueous treatment liquid pass through the animal fibers of the continuous web form. Then the aqueous treatment liquid containing the fine ozone gas bubbles are sucked through the suction port.

According to the construction, the continuous web form of animal fibers, supplied continuously, is transported, or fed, continuously through the tank by the net coveyor; and at the same time, the aqueous treatment liquid is circulated in the tank by the treatment liquid circulation system, thereby treating the continuous web form thereof with the ozone gas.

Also, according to the construction, the ozone gas, dispersed in the aqueous treatment liquid in the form of fine gas bubbles, can stay long in the treatment liquid, and the ozone gas easily passes through the animal fibers of the continuous web form, thereby realizing the effective contact between the ozone gas and the continuous web form.

Also, according to the above construction, the aqueous treatment liquid containing the ozone gas bubbles dispersed therein is discharged from a side of one surface of the mesh belts and the aqueous treatment liquid is sucked from a side of the other surface of the mesh belts. Therefore, the ozone gas is allowed to reach a back surface (or a rear surface) of the continuous web form of animal fibers rapidly. This enables a uniform treatment of the continuous web form thereof with the ozone gas.

More specifically, the treatment apparatus can be embodied as follows.

Preferably, there are provided a pair of treatment liquid circulation systems each of which is the treatment liquid circulation system, and the discharge nozzle of one of the pair of treatment liquid circulation systems is provided on one of sides of the mesh belts, and the discharge nozzle of the other of the pair of treatment liquid circulation systems is provided on the other of sides of the mesh belts in which the discharge nozzle of the one thereof and the discharge nozzle of the other thereof are arranged at different locations with respect to a direction in which the continuous web form of animal fibers is conveyed by the mesh belts.

According to the construction, in one of the pair of treatment liquid circulation systems, the aqueous treatment liquid is discharged toward one surface of the continuous web form of animal fibers from the one of sides of the mesh belts; and at the same time, the aqueous treatment liquid is sucked from the other surface of the continuous web form thereof (i.e. sucked from the other of sides of the mesh belts). On the other hand, in the other of the pair of treatment liquid circulation systems, the aqueous treatment liquid is discharged toward the other surface of the continuous web form of animal fibers from the other of sides of the mesh belts; and at the same time, the aqueous treatment liquid is sucked from the one surface of the continuous web form thereof (i.e. sucked from the one of sides of mesh belts). In the construction, the pair of discharge nozzles are positioned at locations where the pair thereof do not oppose each other, with respect to the mesh belts, or with respect to the continuous web form of animal fibers. With the construction, both sides, or both surfaces, of the continuous web form thereof are uniformly, or evenly, treated with the ozone gas, thereby preventing uneven treatment of the continuous web form thereof with the ozone gas in a direction of thickness of the continuous web form thereof.

Preferably, the tank comprises a generally V-shaped tubular body, having an inner space, that is generally rectangular in cross section, in which the inner space has a dimension allowing the pair of mesh belts to pass through therein, wherein the generally V-shaped tubular body comprises: a descending part inside which the pair of mesh belts move down; an ascending part inside which the pair of mesh belts move up; and a central lower part inside which the pair of mesh belts turn from the descending part to the ascending part, in which the descending part and the ascending part are connected by the central lower part.

According to the construction, the tank comprises a tube-like body (or tubular body) that is generally rectangular in cross section, and the inner space has a dimension which allows the mesh belts to pass through therein. Therefore, with the construction, the amount of the aqueous treatment liquid which is filled in the tank can be small. In other words, with the construction, it is possible to increase the number of ozone gas bubbles per unit volume of the aqueous treatment liquid, by increasing the amount of ozone gas per unit volume thereof, or by reducing the bath ratio.

Also, according to the construction, the tank is formed generally V-shaped, in which the mesh belts move down obliquely, or slantingly, inside the descending part thereof, turn inside the central lower part thereof, and then move up obliquely, or slantingly, inside the ascending part thereof. This construction can shorten the overall length of the tank in a direction in which the continuous web form of animal fibers is conveyed, or carried, or transported, thus reducing the size of the treatment apparatus.

Also, according to the construction, the mesh belts are held in the tilted state; therefore, the ozone gas bubbles are allowed to escape upward along the mesh belts. This results in prevention of accumulation of the ozone gas bubbles at one particular location.

Also, according to the construction, the ozone gas bubbles moving upward along the mesh belts are sucked from the suction port in the tank. Therefore, the reaction of the continuous web-like form of animal fibers with the ozone gas is further effectively promoted.

Preferably, there is further provided a treatment liquid circulation system having a circulation pump which includes an inlet connected to the suction port in the tank and which includes an outlet for returning the aqueous treatment liquid into the tank.

In the construction, the outlet of the circulation pump can be connected to the tank at any arbitrary position.

According to the construction, the circulation pump functions so as to strengthen the force to suck the aqueous treatment liquid by (or from) the suction port in the tank. As a result of the increase in power to suck the aqueous treatment liquid thereby, the suction rate becomes greater than the discharge rate in the treatment liquid circulation system, and the fine ozone gas bubbles can be sucked more rapidly though the suction port.

Incidentally, in order to increase the suction rate of the aqueous treatment liquid in the treatment liquid circulation system, a large-size gas-liquid mixing pump may be used. However, the use of such a large-size pump also leads to the increase in the discharge rate of the aqueous treatment liquid from the discharge nozzle. Namely, even if such a large-size gas-liquid mixing pump is employed in the treatment liquid circulation system, it is difficult to sufficiently suck the discharged ozone gas in the treatment liquid, only with the sucking power of the large-size gas-liquid mixing pump. In contrast, according to the above construction, it is possible to increase the suction rate by an amount which is equivalent to the suction by the circulation pump. Therefore, the ozone gas can be sucked more rapidly by the suction port in the tank.

In the construction, the temperature of the aqueous treatment liquid in the tank can be adjusted easily by adjusting the temperature of the aqueous treatment liquid pumped out from the outlet of the gas-liquid mixing pump.

Preferably, the ozone gas supplied from the ozonizer and a fresh liquid of the aqueous treatment liquid are supplied between the suction port of the tank and the inlet of the gas-liquid mixing pump.

In the construction, the aqueous treatment liquid circulating in the treatment liquid circulation system is employed for treating the continuous web form of animal fibers conveyed, or transported, through the tank, with the ozone gas. Therefore, the treatment liquid may contain substances, or materials, which come off from the continuous web form thereof, such as protein forming the animal fibers. Consequently, if the ozone gas is supplied into the treatment liquid circulation system, the ozone gas may possibly react with such substances or materials, and the ozone gas may be consumed inside the tank, as a result. That is, by supplying the ozone gas and the fresh aqueous treatment liquid between the suction port of the tank and the inlet of the gas-liquid mixing pump, the concentration of such substances or materials contained in the aqueous treatment liquid can be made low, and the reaction of the substances or materials with the newly-supplied ozone gas can be effectively suppressed.

According to the construction, both of the ozone gas and the aqueous treatment liquid, are supplied to a position upstream of the inlet of the gas-liquid mixing pump, and both thereof are sent together to the gas-liquid mixing pump. Therefore, both of the ozone gas and the aqueous treatment liquid are mixed together preliminarily inside the gas-liquid mixing pump. Accordingly, with this construction, the efficiency of mixing the ozone gas with the aqueous treatment liquid by the static mixer is increased.

Preferably, there are provided a plurality of discharge nozzles each of which is the discharge nozzle, wherein the discharge nozzle has a predetermined length in a direction of width of the mesh belts, and wherein the plurality of discharge nozzles are provided in the direction of width thereof so that the plurality of discharge nozzles extend from both sides, in the direction of width, of the mesh belts toward a center of the mesh belts in the direction of width.

That is, when the continuous web-like form of animal fibers has a predetermined width, it is preferable to make the continuous web-like form thereof react with the fine gas bubbles of the ozone gas uniformly, or evenly, also in the direction of width of the web-like form (i.e. in the direction of width of the mesh belts), by making the ozone gas contact with the continuous web form thereof. In order to realize this, a discharge nozzle having a predetermine length in the direction of width of the mesh belts, can be employed effectively. However, when the aqueous treatment liquid containing the ozone gas bubbles dispersed uniformly therein is supplied to the discharge nozzle, the amount of the fine ozone gas bubbles discharged through the discharge nozzle under the discharge pressure varies in the direction of width of the continuous web form thereof, or in the direction of width of the mesh belts. As a result, it becomes difficult to evenly treat the continuous web-like form thereof with the ozone gas. In this connection, according to the above construction of the present invention, there are provided a plurality of discharge nozzles in the treatment liquid circulation system, and the plurality of discharge nozzles are provided in the direction of width of the mesh belts so that the plurality of discharge nozzles extend from both sides, in the direction of width thereof, of the mesh belts towards the center of the mesh belts in the direction of width thereof. Consequently, the difference in discharge rate of the ozone gas in the direction of width thereof is reduced or diminished. Namely, with the construction, it is possible to reduce the unevenness, or non-uniformity, of treatment of the continuous web form of animal fibers with the ozone gas in the direction of width of the continuous web form thereof, or in the direction of width of the mesh belts.

Preferably, each of the fine gas bubbles has a size of 50 microns or less.

With the fine gas bubbles of the ozone gas, the ozone gas bubbles can stay longer in the aqueous treatment liquid in a state in which the ozone gas bubbles are dispersed therein. Thereby, it is possible to prolong the time, or duration, to treat the continuous web-like form of animal fibers with the ozone gas.

Also, with the fine gas bubbles of the ozone gas, the fine ozone gas bubbles can easily pass through gaps, or spaces, amongst the animal fibers of the continuous web form. Thereby, it is possible to make the ozone gas bubbles contact the continuous web form thereof up to the inside of the continuous web form, and it is possible to make the ozone gas bubbles react with the continuous web-like form thereof up to the inside thereof.

BRIEF DESCRIPTION OF THE DRAWINGS

This and other objects and features of the present invention will become clear from the following description taken in conjunction with the preferred embodiment thereof with reference to the accompanying drawings.

DETAILED DESCRIPTION OF THE PREFERRED EMBODIMENT

Figure 1:
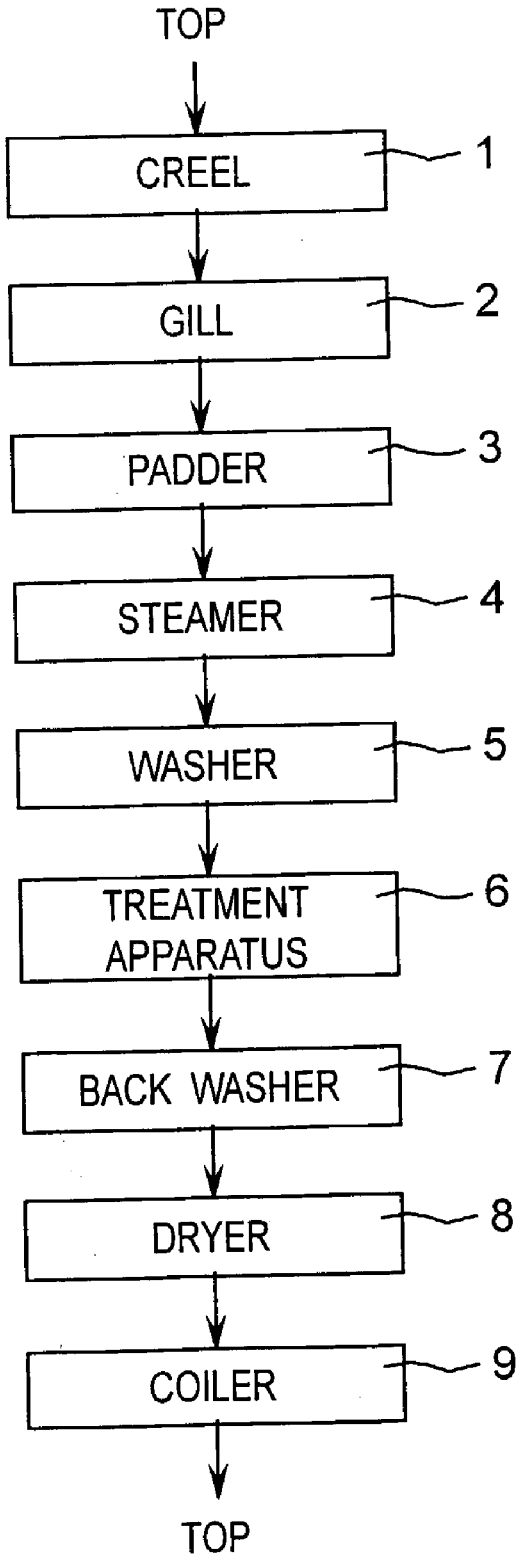
FIG. 1 is an arrangement plan view of a wool fiber treatment system including a treatment apparatus, for chemical modification of animal fibers of the continuous web-like form, according to the present invention.

Before the description of a preferred embodiment of the present invention proceeds, it is to be noted that like or corresponding parts are designated by like reference numerals throughout the accompanying drawings.

With reference to FIGS. 1 through 11, a description is made below upon a treatment apparatus for reforming a continuous web form (or continuous web-like form) of animal fibers, according to the preferred embodiment of the present invention.

FIG. 1 is an arrangement view of a wool fiber treatment system including the treatment apparatus of the preferred embodiment. To this system, wool in the form of a top which is not treated by ozone, is used as a supply material. The wool is treated by ozone with the treatment apparatus of the preferred embodiment which is arranged in the wool fiber treatment system, and the ozone-treated wool is again wound up in the form of a top as a finished product (or an end product).

That is, first, with the use of a creel 1, the top as the supply material is unwound, and a plurality of slivers are bound together to form a bundle with predetermined width. The slivers are then combed, or gilled, by a gill 2 for making the width thereof greater, in order to form or obtain a continuous web form of wool fibers having a width of about 135 mm. The continuous web-like form of the wool fibers thus gilled therewith, is then impregnated with an aqueous pretreatment solution by a padder 3, in order to improve, or increase, the efficiency in the subsequent ozone treatment. Then, the continuous web-like form of the wool fibers thus impregnated with the aqueous pretreatment solution, is kept at a predetermined temperature by a steamer 4, in order to promote the reaction of the continuous form thereof with the aqueous pretreatment solution. This pretreatment is desirable, because the impregnation of the wool fibers therewith before the wool fibers are subjected to blowing of the ozone gas in water, enhances the reforming effect. After the aqueous pretreatment solution is washed away from the wool fibers by a washer 5, the continuous web-like form of the wool fibers is supplied to the treatment apparatus 6 of the preferred embodiment.

The treatment apparatus 6 of the embodiment performs the ozone treatment so that an aqueous treatment liquid containing the ozone gas as superfine bubbles is blown to the continuous structure of the wool fibers while the continuous form thereof is being conveyed in succession through the aqueous treatment liquid. As a result, the surface of each wool fiber is reformed, and thus the property of resistance against shrink and the property of resistance against pilling are improved, without spoiling the wool-intrinsic excellent hand-feeling and water repellency. Specifically, this treatment apparatus is an apparatus for continuously executing the method for reforming animal fibers which is disclosed in Japanese Laid-Open Patent Publication No. 2001-164460.

Then, the aqueous treatment liquid is washed away from the wool fibers of the continuous form which has been moved from the treatment apparatus 6 by a back washer 7, and the continuous form thereof is dried by a dryer 8.

Finally, the continuous web form of the wool fibers is wound by a coiler 9 to be provided as a top.

Figure 2:
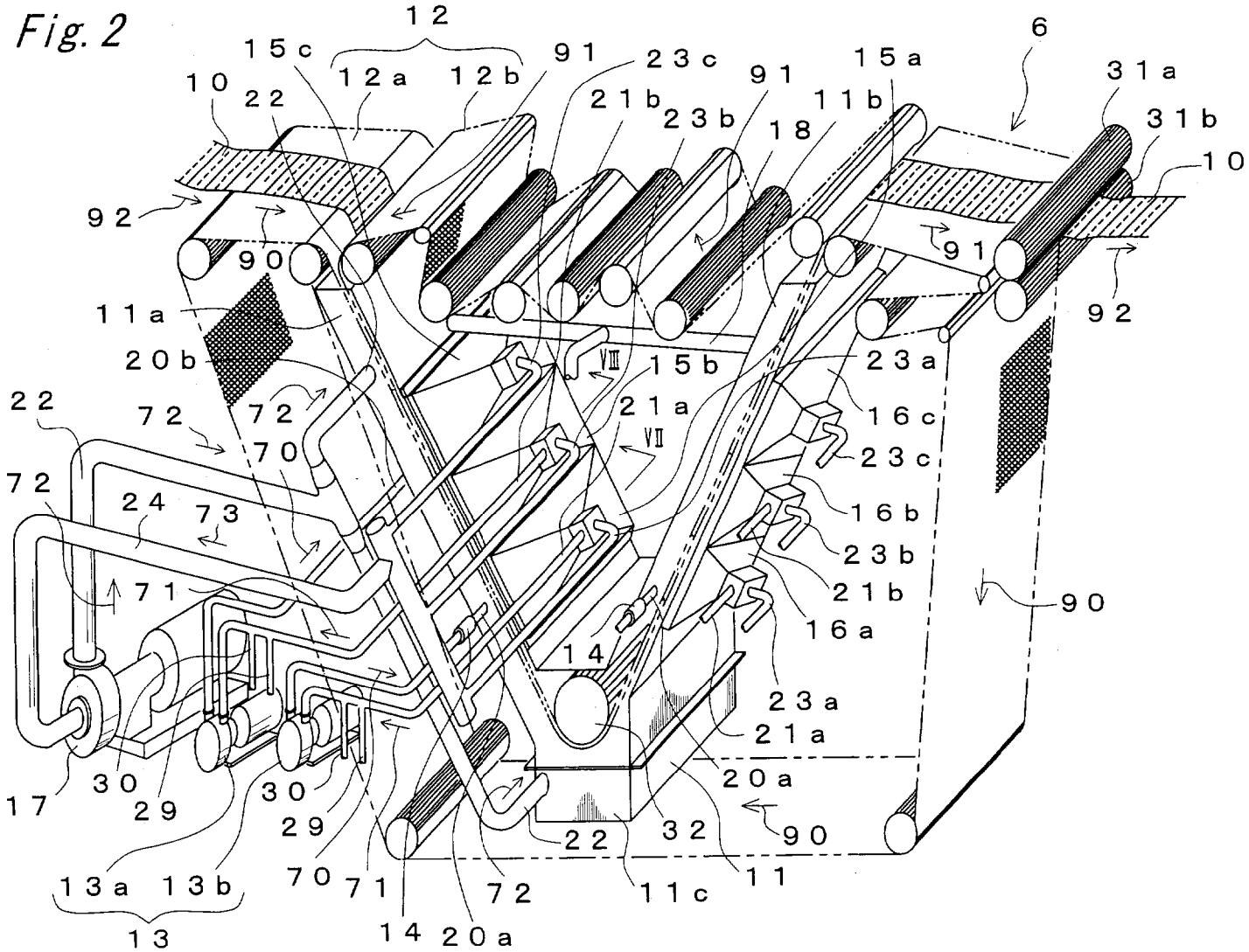
FIG. 2 is a schematic perspective view of the treatment apparatus of FIG. 1.

FIG. 2 is a schematic perspective view of the treatment apparatus of the embodiment. In the treatment apparatus 6, the wool fibers of the continuous web form 10, sandwiched or held between a pair of two mesh belts 12*a* and 12*b*, is allowed to pass through an inner space of a tank 11, generally V-shaped in cross section, filled with the aqueous treatment liquid. The aqueous treatment liquid containing superfine ozone bubbles, is discharged (or blown or jetted) toward the wool fibers of the continuous web form 10 that is being conveyed, from one surface of the continuous form thereof. Simultaneously, the aqueous treatment liquid containing the ozone gas bubbles is sucked by suction ports 15 (i.e. 15*a*, 15*b*, 15*c*); 16 (i.e. 16*a*, 16*b*, 16*c*) which are arranged on the other surface (or on the opposite surface) of the wool fibers of the continuous form.

The tank 11 is dimensioned as follows. Namely, the tank 11 has a tube-like body having a generally rectangular cross section of which the inner space has a dimension large enough to allow the two mesh belts 12 (i.e. 12*a*, 12*b*) to pass therethrough. The body is bent into a generally V-shape with its center portion locating at a low position so that the mesh belts 12 passing through the inner space descend once and then ascend therein. That is, the tank 11 has a descending portion 11*a* allowing the two mesh belts 12 to descend, an ascending portion 11*b* allowing the mesh belts 12 to ascend, and a turning portion 11*c* locating therebetween. Each of the descending and ascending portions 11*a* and 11*b* is, respectively, tilted with respect to the normal, as shown in FIG. 2.

The tank 11 is filled with the aqueous treatment liquid. The tank 11 is replenished with a fresh liquid by gas-liquid mixing pumps 13 (i.e. 13*a*, 13*b*, 13*c*, 13*d*) as will be described later, and an amount of the liquid exceeding a predetermined level is drained from the tank 11 via a drain outlet 18.

Each of the two mesh belts 12*a* and 12*b* which are allowed to pass through the inside of the tank 11, is made of a metal meshed endless belt, and the two mesh belts 12*a* and 12*b* are arranged to move along a predetermined route over a plurality of rollers at generally the same speed. A part of the lower mesh belt 12*a* thereof moves along a route corresponding to a lower part inside the tank 11, as shown by an arrow 90 in the figure. On the other hand, a part of the upper mesh belt 12*b* moves along a route corresponding to an upper part inside the tank 11, as shown by an arrow 91 therein. The two mesh belts 12*a* and 12*b* which are put together one on the other so as to sandwich, or pinch, the wool fibers of the continuous web form 10 therebetween at a location near an entrance of the tank 11, descend in the descending portion 11*a* of the tank 11 in a tilted state, are turned in the turning portion 11*c* thereof, and then ascend in the ascending portion 11*b* thereof in a tilted state. After passing through an exit of the tank 11, the two mesh belts 12*a* and 12*b* separate from each other.

Incidentally, the wool fibers of the continuous web form which has been released from the mesh belts 12*a* and 12*b*, is compressed vertically with a pair of squeezing rollers 31*a* and 31*b* for squeezing out the aqueous treatment liquid, and then the squeezed structure of the wool fibers is sent to the back washer 7.

Each of the descending portion 11*a* and the ascending portion 11*b*, of the tank 11, is provided with discharge nozzles for discharging the aqueous treatment liquid including superfine ozone gas bubbles dispersed therein, and is provided with the suction ports 15 (i.e. 15*a*, 15*b*, 15*c*) and 16 (i.e. 16*a*, 16*b*, 16*c*), respectively, for sucking the aqueous treatment liquid. The discharge nozzles and the suction ports 15 and 16, will be described later in detail.

Inside the turning portion 11*c* of the tank 11, there is arranged a turn roller 32 for turning, or changing, a direction in which the two mesh belts 12*a* and 12*b* are carried or transported, in a state in which the two mesh belts 12*a* and 12*b* are overlapped on each other. The turn roller 32 is a drive roller which is driven by a drive motor 34*a*, as will be explained later (refer to FIG. 3).

The treatment apparatus 6 has two types of pumps, which are: four gas-liquid mixing pumps 13*a*, 13*b*, 13*c*, 13*d* and two circulation pumps 17, 17. More specifically, two gas-liquid mixing pumps 13*a*, 13*b* and one circulation pump 17 are mounted on the side of the descending portion 11*a*; on the other hand, two gas-liquid mixing pumps 13*c*, 13*d* and one circulation pump 17 are mounted on the side of the ascending portion 11*b*. By the way, FIG. 2 shows only the two gas-liquid mixing pumps 13*a*, 13*b* and the one circulation pump 17 which locate on the side of the descending portion 11*a*.

As explained above, the two gas-liquid mixing pumps 13 (13*a* and 13*b*), and the two gas-liquid mixing pumps 13 (13*c* and 13*d*) are provided for the descending portion 11*a* and the ascending portion 11*b*, of the tank 11, respectively. Each of the gas-liquid mixing pumps 13*a*, 13*b*, 13*c*, 13*d* has an inlet which is connected to each of the suction ports 15*b*, 15*a*, 16*a*, 16*b* which are mounted on the tank 11; and each of the gas-liquid mixing pumps 13*a*, 13*b*, 13*c*, 13*d* has an outlet for discharging, or blowing out, both of the aqueous treatment liquid and the ozone gas dispersed therein, into the tank 11, simultaneously. Each of the gas-liquid mixing pumps 13*a*, 13*b*, 13*c*, 13*d* constitutes a circulation system of the treatment liquid, together with a static mixer 14 which is connected downstream of the outlet of the gas-liquid mixing pump and together with a discharge nozzle connected downstream of the static mixer 14, in which the discharge nozzle is placed at a position facing the corresponding suction port 15 (i.e. 15*b*, 15*a*), 16 (i.e. 16*b*, 16*a*) of the tank 11 with respect to the mesh belt 12 (i.e. 12*a*, 12*b*).

In the arrangement, as the gas-liquid mixing pump 13 (i.e. 13*a*, 13*b*, 13*c*, 13*d*), the pump which is capable of preventing drop in flow and pressure of the aqueous treatment liquid to be pumped out, is employed, even when the pump sucks ozone gas equal to an amount as much as one-tenth of the flow of the aqueous treatment liquid. Specifically, it is preferable to employ a gas-liquid mixing pump of OMC32-6 (model name or type name), manufactured by Oshima Machinery & Co., Ltd.

Hereinafter, it will be explained typically about an aqueous treatment liquid circulation system including the gas-liquid mixing pump 13*a* of all the four aqueous treatment liquid circulation systems arranged in the treatment apparatus, two of which are arranged for the descending portion 11*a*, and two of which are arranged for the ascending portion 11*b*.

The descending portion 11*a* of the tank 11 has the three suction ports 15*a*, 15*b* and 15*c*. The suction port 15*a* located at the lowest position is connected to the inlet of the gas-liquid mixing pump 13*b*. In the arrangement, by driving the gas-liquid mixing pump 13*b*, the aqueous treatment liquid in the tank 11 is sucked through the suction port 15*a* and a pipe 21*a* into the inlet of the gas-liquid mixing pump 13*b*, as shown by an arrow 71. The pipe 21*a* has a supply port 29 for passing the aqueous treatment liquid and has a supply port 30 for passing the ozone gas at certain positions of the pipe 21*a*, respectively, as will be explained later.

The supplied aqueous treatment liquid and the supplied ozone gas, are dispersed preliminarily in the gas-liquid mixing pump 13*b*, and they are pumped out from the outlet to the static mixer 14 via a pipe 20*a*. As the static mixer 14, it is preferable to employ such a mixer which can generate, or form, fine gas bubbles and which can mix a large amount of aqueous treatment liquid with the gas. Specifically, an OHR Line Mixer (product name) manufactured by Seika Industry & Co., Ltd. is preferably employed. With the static mixer 14, the ozone gas in the aqueous treatment liquid is changed into superfine gas bubbles having a size of 30 microns or less, which are dispersed in the aqueous treatment liquid, uniformly or evenly.

The pipe 20*a* extends through a side-wall of the descending portion 11*a* of the tank 11, and it enters the inside of the tank 11. At the tip of the pipe 20*a*, is mounted the discharge nozzle, from which the aqueous treatment liquid including the fine ozone gas bubbles dispersed therein is blown out, or jetted out. Most of the aqueous treatment liquid and the ozone gas, discharged from the discharge nozzle, are sucked by the suction port 15*a*, and the liquid including the gas thus sucked circulate in the circulation system as aforementioned.

The aqueous treatment liquid circulation system including the gas-liquid mixing pump 13*a* also has an arrangement (or construction) which is substantially equal to the arrangement (or construction) as aforementioned, except that a pipe 20*b* extends through the side-wall which is opposite to the side-wall through which the pipe 20*a* extends.

Similarly, a pair of aqueous treatment liquid circulation systems are provided for the ascending portion 11*b* of the tank 11. However, in contrast with the arrangement of the descending portion 11*a*, there exists a difference in that the position of the discharge nozzles and the position of the suction ports in the ascending portion 11*b* with respect to the mesh belts 12 (i.e. 12*a*, 12*b*) are reverse to those in the aqueous treatment liquid circulation system for the descending portion 11*a*. This will be described later.

Next, it is explained about the circulation pump 17. One circulation pump 17 is mounted for each of the descending portion 11*a* and the ascending portion 11*b* of the tank 11. The circulation pump 17 is provided mainly for the purpose of enhancing the suction force in the circulation systems. The inlet of the circulation pumps 17, 17 are connected to the suction ports 15 (i.e. 15*a*, 15*b*, 15*c*) and 16 (i.e. 16*a*, 16*b*, 16*c*) of the tank 11 through pipes 23*a*, 23*b* and 23*c*, for mainly sucking the aqueous treatment liquid.

The aqueous treatment liquid which has been sucked through the suction port 15 (15*a*, 15*b* and 15*c*) provided for the descending portion 11*a* and through the suction port 16 (16*a*, 16*b* and 16*c*) provided for the ascending portion 11*b*, of the tank 11, is sent, or transported, to the circulation pumps 17, 17 via a pipe 24 as shown by an arrow 73. The aqueous treatment liquid in each of the circulation pumps 17, 17 is then pumped back into the tank 11 at an upper position and a position in the turning portion 11*c*, as shown by an arrow 72. During the liquid circulation, the temperature of the aqueous treatment liquid is adjusted, so that the temperature of the aqueous treatment liquid in the tank 11 is easily adjusted.

With the provision of the circulation pumps 17 in the treatment apparatus, the suction rate of the ozone gas through the suction ports 15 (i.e. 15*a*, 15*b*, 15*c*) and 16 (i.e. 16*a*, 16*b*, 16*c*) becomes greater than the discharge rate of the ozone gas which is blown, or jetted, toward the wool fibers of the continuous web form, thus increasing the rate, or speed, of suction of the ozone gas. Namely, this enables the ozone gas bubbles dispersed in the aqueous treatment liquid to react with the wool fibers of the continuous web form before the bubbles of the ozone gas rise and separate in the liquid, thus improving, or enhancing, the efficiency in the chemical modification of the wool fibers.

Figure 3:
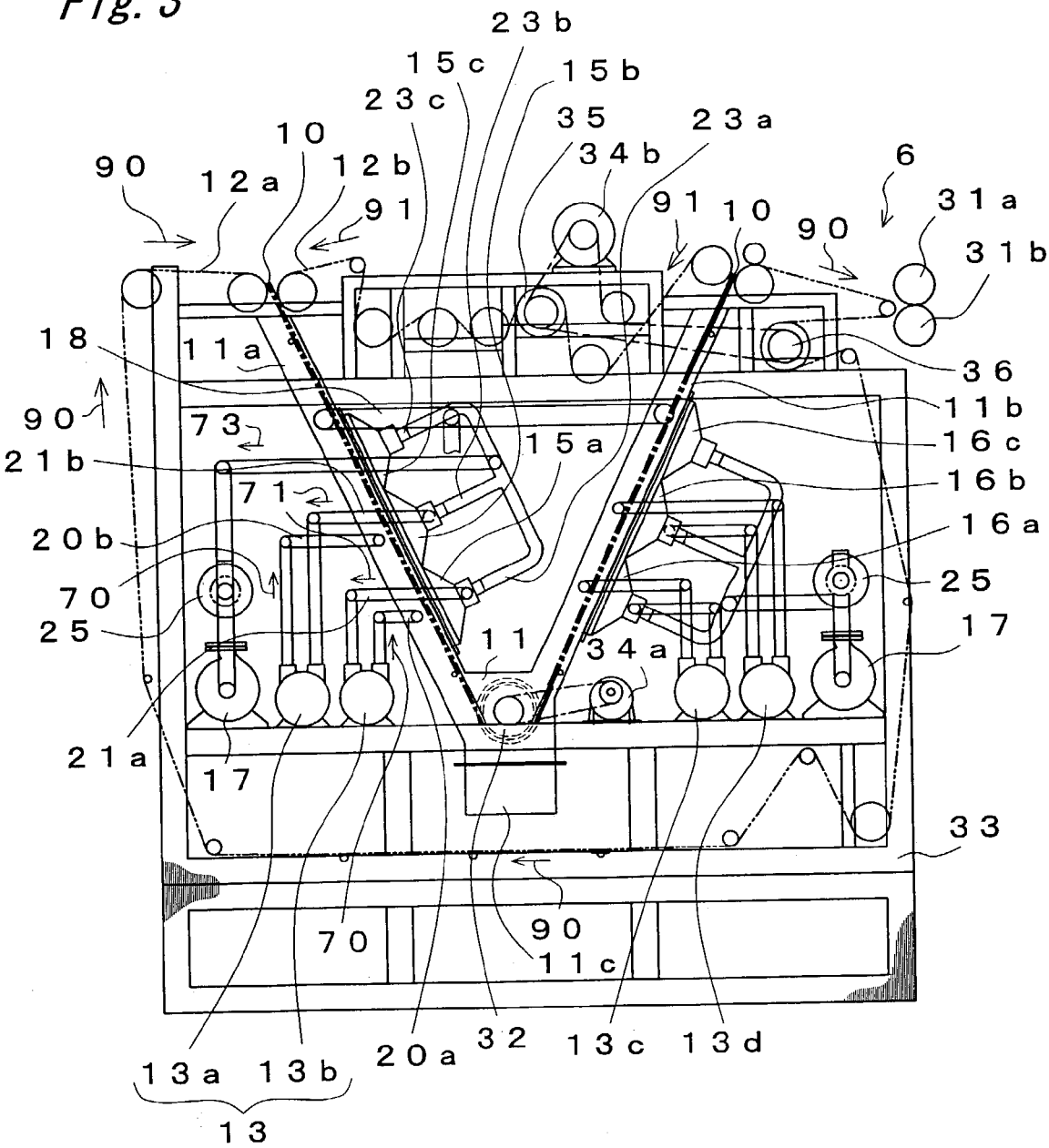
FIG. 3 is a schematic front view to explanatorily illustrate a construction of the treatment apparatus of FIG. 2.

FIG. 3 is a schematic front view to explanatorily illustrate the construction of the treatment apparatus 6 of FIG. 2. Namely, on a frame 33 of the treatment apparatus 6, there are arranged the aforementioned tank 11 which has the generally V-shaped cross-section, the gas-liquid mixing pumps 13 (i.e. 13*a*, 13*b*; 13*c*, 13*d*), the circulation pumps 17 and 17, the drive motors 34 (i.e. 34*a*, 34*b*) for driving the mesh belts 12*a* and 12*b*, and so on.

The lower mesh belt 12*a* and the upper mesh belt 12*b*, are driven by driving rollers 32, 35 and 36 which are driven to rotate by force transmitted, or exerted, from the drive motors 34*a* and 34*b*.

The mesh belts 12 (i.e. 12*a*, 12*b*) moved, or carried, inside the tank 11, are turned by the drive roller 32 which is placed at the turning portion 11*c* of the tank 11. As shown in FIG. 3, the turning portion 11*c* is configured so that the side of the ascending portion 11*b* is higher than the side of the descending portion 11*a*, and so that the driving roller 32 is placed at a deviated position closer to the ascending portion 11*b*. With this arrangement, the mesh belts 12 can be moved through the descending portion 11*a* and the ascending portion 11*b* of the tank 11 along a route, or a course, closer to the suction ports 15 (i.e. 15*a*, 15*b*, 15*c*) mounted on the upper wall of the descending portion 11*a* and closer to the suction ports 16 (i.e. 16*a*, 16*b*, 16*c*) mounted on the lower wall of the ascending portion 11*b*, respectively. That is, with the arrangement, it is possible to strongly suck, or absorb, the aqueous treatment liquid including the ozone gas bubbles blown from the discharge nozzles with the suction ports 15 and 16.

Figure 4:
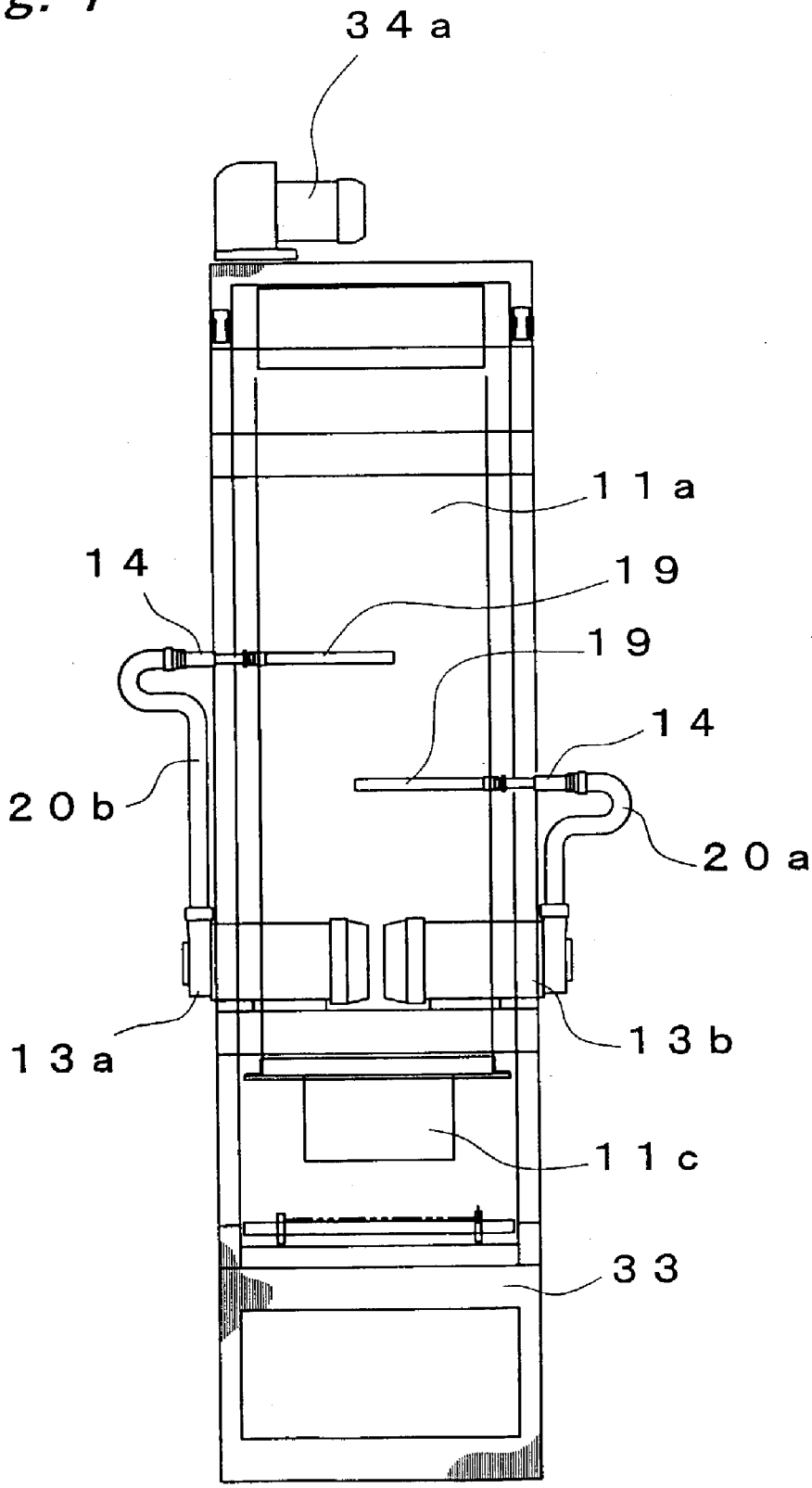
FIG. 4 is a schematic left-hand view of the treatment apparatus of FIG. 3.
Figure 5:
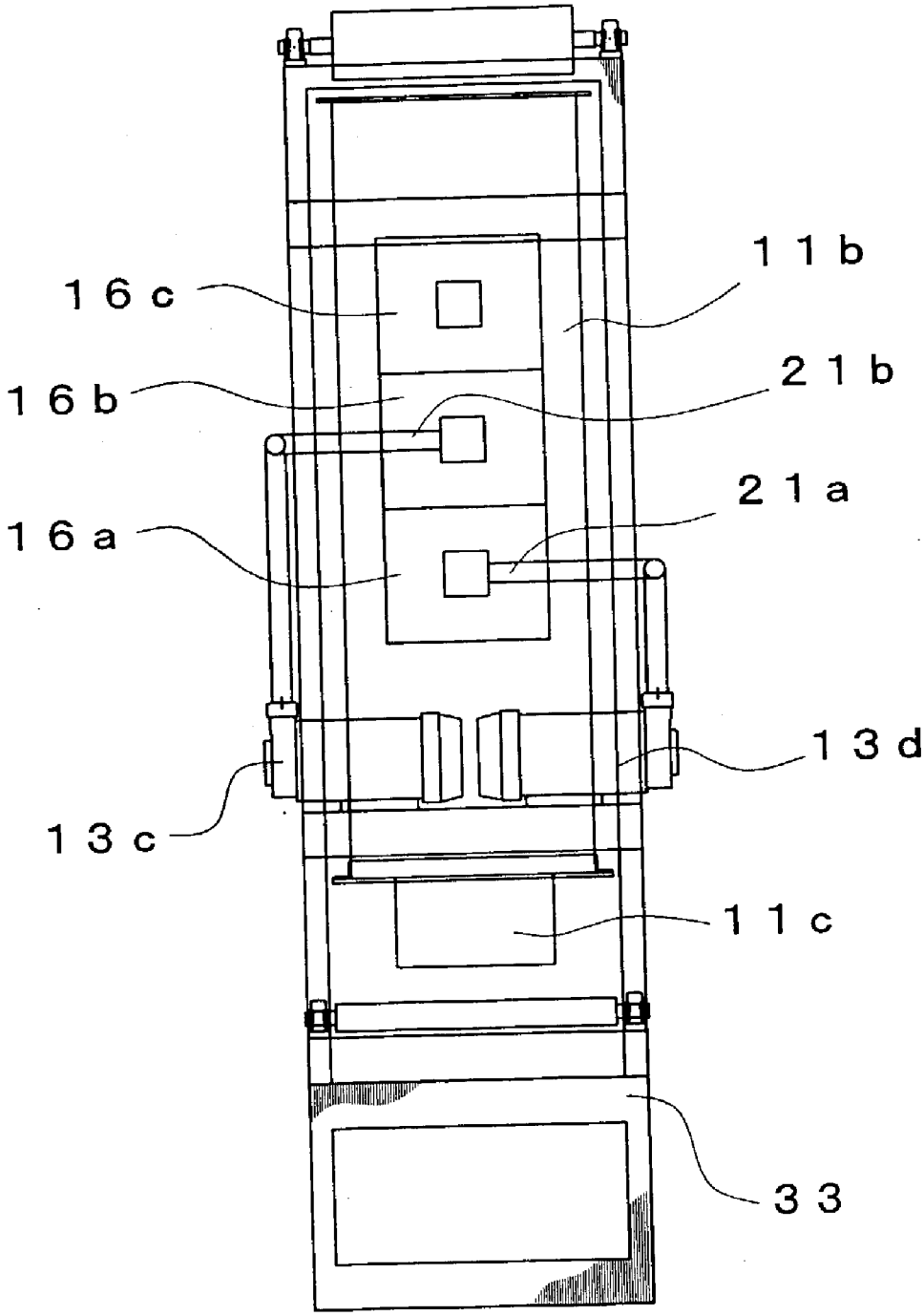
FIG. 5 is a schematic right-hand view of the treatment apparatus of FIG. 3.

FIG. 4 is a schematic left-hand view of the treatment apparatus of FIG. 3, and FIG. 5 is a schematic right-hand view of the treatment apparatus of FIG. 3. As described above, a total of four aqueous treatment liquid circulation systems including the gas-liquid mixing pumps 13*a*, 13*b*; 13*d*, 13*d*, are provided in the treatment apparatus 6. Namely, two aqueous treatment liquid circulation systems are provided for the descending portion 11*a* of the tank 11, and two aqueous treatment liquid circulation systems are provided for the ascending portion 11*b* thereof. In the arrangement, each of the four circulation systems includes the discharge nozzle 19 for discharging the aqueous treatment liquid including fine ozone gas bubbles dispersed therein uniformly. The discharge nozzle 19 has a length which extends in a direction of width of the continuous web form 10 of the wool fibers so that the ozone gas bubbles can be delivered to the entire surface of the continuous web form 10 thereof uniformly and evenly.

However, in a case that the discharge nozzle having a too long hole or slit (refer to FIGS. 9 and 10) is employed, and in a case that the aqueous treatment liquid having the ozone gas bubbles dispersed therein uniformly is supplied to the discharge nozzle 19, the discharge amount and/or discharge speed (or discharge rate) of the liquid from the hole or slit decreases as the position where the liquid is discharged is farther away from the proximal end of the discharge nozzle. In other words, in a case that a discharge nozzle having a length exceeding a predetermined one is employed, the amount of discharge of the fine ozone gas bubbles therefrom varies along the length of the discharge nozzle, or the amount thereof has a distribution in the direction of the length of the discharge nozzle, thus making it difficult to uniformly treat the wool fibers of the continuous web form with the ozone gas bubbles.

Figure 7:
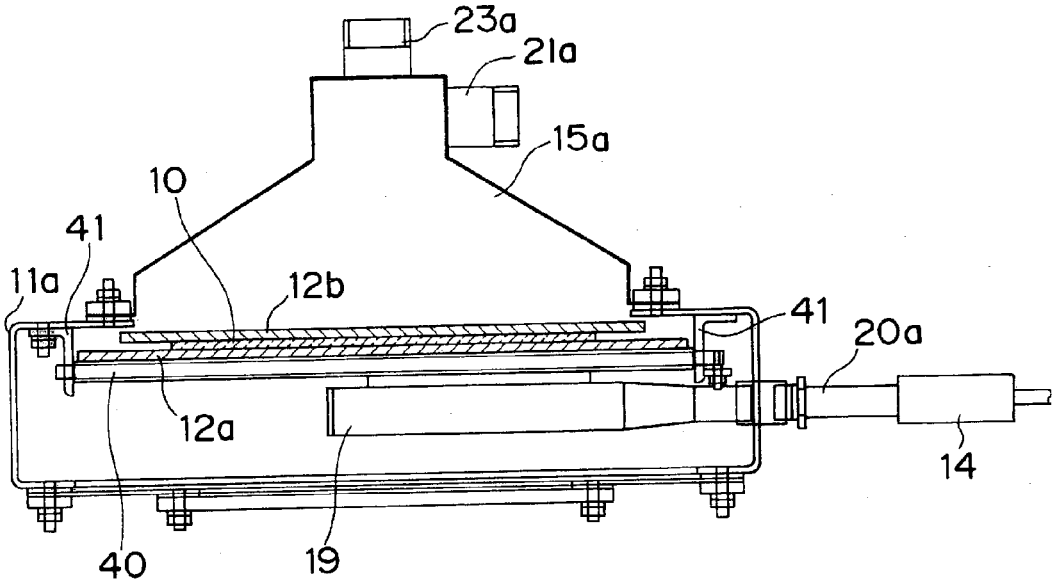
FIG. 7 is a cross-sectional view taken along a line of VII in FIG. 2.
Figure 8:
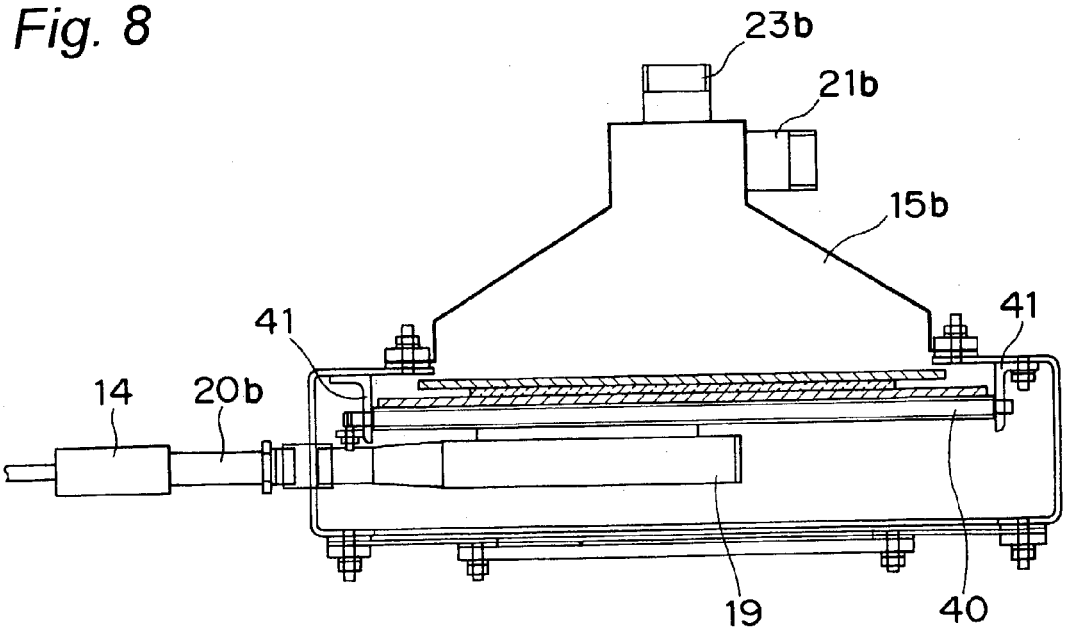
FIG. 8 is a cross-sectional view taken along a line of VIII in FIG. 2.

In the treatment apparatus 6 of the preferred embodiment, as shown in FIGS. 4, 7 and 8, each of the discharge nozzles 19 employed in each of the circulation systems is made short, and the each thereof is arranged, or aligned, in the direction of the width of the tank 11 (i.e. the width of the descending portion 11*a*, and the width of the ascending portion 11*b*), in order to uniformize the discharge rate of the ozone gas bubbles therefrom.

In addition, as shown in FIG. 4, the discharge nozzles are positioned so that the aqueous treatment liquid is supplied toward the center of the tank 11 with respect to the direction of the width of the tank 11, through the discharge nozzles 19 and 19, from both side-walls of the tank 11. By this arrangement, the difference (or non-uniformity) in discharge rate, or discharge amount, of the aqueous treatment liquid in the direction of width thereof is reduced, thus diminishing, or preventing, non-uniformity in the treatment of the wool fibers with the ozone gas.

As shown in FIG. 3, the suction ports 15 (i.e. 15*a*, 15*b*) are mounted on the descending portion 11*a* of the tank 11 in opposition to the discharge nozzles 19 and 19 with respect to the mesh belts 12*a* and 12*b* which are located between the suction ports 15 (i.e. 15*a*, 15*b*) and the discharge nozzles 19 and 19. Also, as shown in FIGS. 3 and 5, the suction ports 16 (i.e. 16*a*, 16*b*) are mounted on the ascending portion 11*b* of the tank 11 in opposition to the discharge nozzles 19, 19 with respect to the mesh belts 12*a* and 12*b* which are located between the suction ports 16 (i.e. 16*a*, 16*b*) and the discharge nozzles 19, 19.

Figure 6:
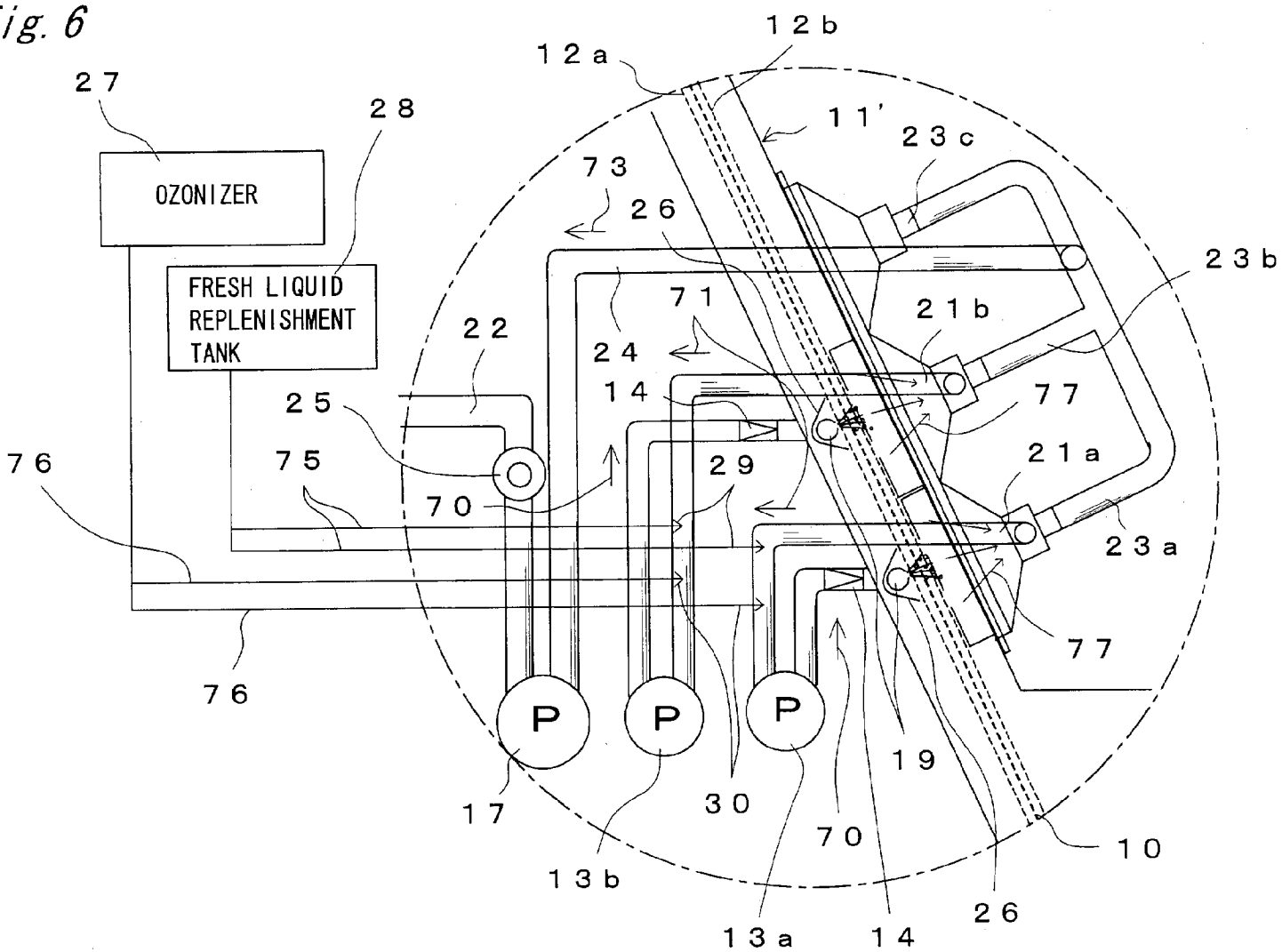
FIG. 6 is a schematic view to explanatorily illustrate a construction of a circulation system provided in the treatment apparatus of FIG. 2.

FIG. 6 is a schematic view to explanatorily illustrate the construction of circulation systems in the treatment apparatus of FIG. 2. As described above, the treatment apparatus 6 has the circulation systems including the four gas-liquid mixing pumps 13 (i.e. 13*a*, 13*b*, 13*c*, 13*d*) and has the circulation systems including the two circulation pumps 17, 17. Each of the gas-liquid mixing pumps 13 has a discharge pressure of 4 to 8 kg/cm$^2$ and a discharge rate of 80 L/min. On the other hand, each of the circulation pumps 17, 17 has a discharge pressure of 0.5 kg/cm$^2$ and a discharge rate of 200 L/min.

As aforementioned, in the circulation systems including the gas-liquid mixing pumps 13 (i.e. 13*a*, 13*b*, 13*c*, 13*d*), the inlets of the gas-liquid mixing pumps 13 are connected to the suction ports 15 (i.e. 15*a* and 15*b*) and 16 (i.e. 16*a* and 16*b*), so that the ozone gas and the aqueous treatment liquid sucked thereby are sent to the gas-liquid mixing pumps 13 through the pipes 21*a* and 21*b*. As shown in FIGS. 2 and 6, at predetermined locations of each of the pipes 21*a* and 21*b*, there are provided the supply port 29 for adding a fresh aqueous treatment liquid from a fresh liquid replenishment tank 28 as shown by an arrow 75 and the supply port 30 for adding the ozone gas from an ozonizer 27 as shown by an arrow 76. In this way, by arranging the supply ports 29 and 30 at predetermined locations of the supply-side pipes 21 (i.e. 21*a* and 21*b*) connected to the inlets of the gas-liquid mixing pumps 13 (i.e. 13*a*, 13*b*, 13*c*, 13*d*), the ozone gas and the fresh aqueous treatment liquid can be supplied to the gas-liquid mixing pumps 13 at a low pressure. In addition, with the arrangement, the possibility that the used aqueous treatment liquid containing any outflow substance coming off from the animal fibers may react with the ozone gas, is effectively lowered or suppressed.

The aqueous treatment liquid and the ozone gas are pumped out by the gas-liquid mixing pumps 13 (i.e. 13*a*, 13*b*, 13*c*, 13*d*) to the static mixers 14 through the pipes 20*a* and 20*b*, and the ozone gas is mixed with the aqueous treatment liquid so that superfine ozone gas bubbles are formed in the aqueous treatment liquid and they are dispersed therein, in the static mixers 14. The aqueous treatment liquid including the fine ozone gas bubbles is then discharged, or jetted, from the discharge nozzles 19 toward one surface of the mesh belt 12 (i.e. 12*a*, 12*b*). In order to make the ozone gas bubbles efficiently come into contact with the mesh belt 12, there is provided a nozzle cover 26 along a partial circumference of each of the discharge nozzles 19, as shown in FIG. 6.

FIG. 7 is a cross-sectional view taken along a line of VII in FIG. 2; and FIG. 8 is a cross-sectional view taken along a line of VIII in FIG. 2. These figures show the arrangements of the discharge nozzles 19, 19 and the suction ports 15*a*, 15*b* of the two lower circulation systems which are mounted on the descending portion 11*a* of the tank 11. In the respective circulation systems, the suction ports 15*a* and 15*b* are placed as close to the mesh belts 12 as possible. The suction port 15*a* is coupled with the pipe 21*a* which is connected to the inlet of the gas-liquid mixing pump 13*b*, and the suction port 15*a* is also coupled with the pipe 23*a* which is connected to the circulation pump 17. Similarly, the suction port 15*b* is coupled with the pipe 21*b* which is connected to the inlet of the gas-liquid mixing pump 13*a*, and the suction port 15*b* is also coupled with the pipe 23*b* which is connected to the circulation pump 17.

As shown in FIGS. 7 and 8, in order to guide the mesh belts 12 (i.e. 12*a*, 12*b*), there are provided a plurality of L-shaped guides 41 fixed to the inside of the tank 11 and a plurality of guide rollers 40 which are rotatably supported by and between the corresponding two guides 41. With the arrangement, the guide rollers 40 prevent the mesh belts 12*a* and 12*b* from sagging under their own weights.

As aforementioned, each of the discharge nozzles 19 is placed at a position facing each of the corresponding suction ports 15 (i.e. 15*a*, 15*b*), 16 (i.e. 16*a*, 16*b*) with the mesh belts 12 locating therebetween. The two discharge nozzles 19, 19 extend through the opposite side-walls of each of the descending portion 11*a* and ascending portion 11*b* of the tank 11, and they are fixed to the guides 41, respectively, as shown in FIGS. 7 and 8. In the arrangement, the aqueous treatment liquid including the fine gaseous ozone bubbles sent from the static mixers 14 is discharged from the discharge nozzles 19, in which non-uniformity, or unevenness, of treatment of the wool fibers of the continuous web form with the ozone gas in the direction of width thereof is suppressed or prevented.

Figure 9:
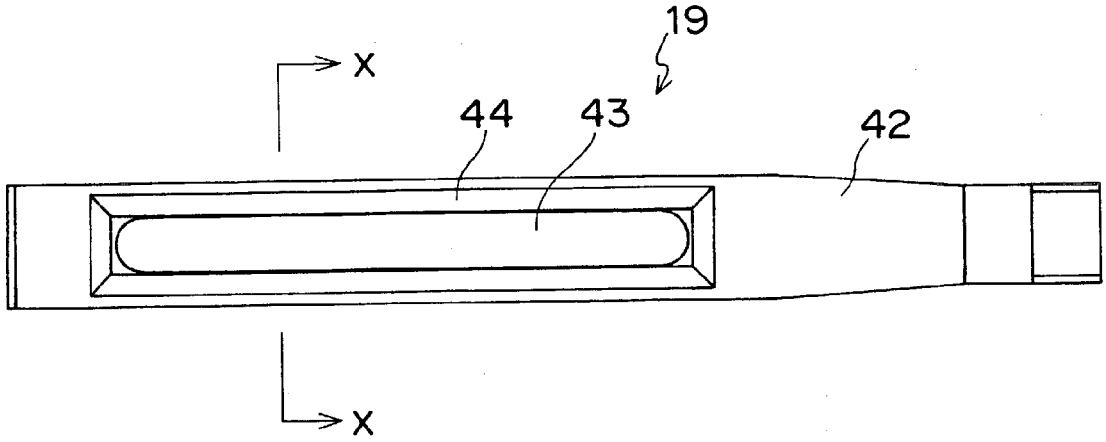
FIG. 9 is a view showing a structure of a discharge nozzle which is employed in the treatment apparatus of FIG. 2.
Figure 10:
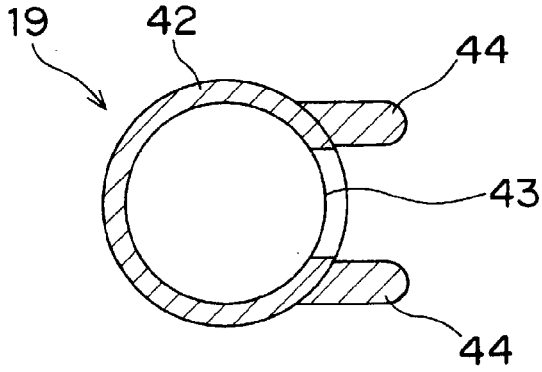
FIG. 10 is a cross-sectional view taken along a line of X—X in FIG. 9.

FIGS. 9 and 10 are views showing the structure of the discharge nozzle 19. The discharge nozzle 19 has a cylindrical body 42 having an elongate hole 43 for discharging, or jetting, the aqueous treatment liquid including the fine ozone gas bubbles. The cylindrical body 42 has a scatter prevention wall 44, mounted so as to surround the elongate hole 43, for the purpose of directing, or guiding, the ozone gas bubbles toward the mesh belts 12.

In the arrangement, the aqueous treatment liquid including the ozone gas bubbles discharged from the discharge nozzles 19, is guided toward the mesh belts 12*a* and 12*b* by the scatter prevention walls 44, with the aqueous treatment liquid being prevented from spreading out or scattering by the scatter prevention walls 44. The treatment liquid including the ozone gas bubbles thus jetted from the discharge nozzles 19, passes through meshes, or openings, of the mesh belts 12*a* and 12*b*, and the treatment liquid including the ozone gas bubbles comes into contact with the continuous web form of the wool fibers. As shown by an arrow 77 in FIG. 11 which is an explanatory view showing a movement of the ozone gas bubbles 39 in the aqueous treatment liquid, the aqueous treatment liquid including the ozone gas bubbles 39 passes through the continuous web form 10 thereof by being sucked toward the suction ports 15 (i.e. 15*a* and 15*b*) and 16 (i.e. 16*a* and 16*b*).

Figure 11:
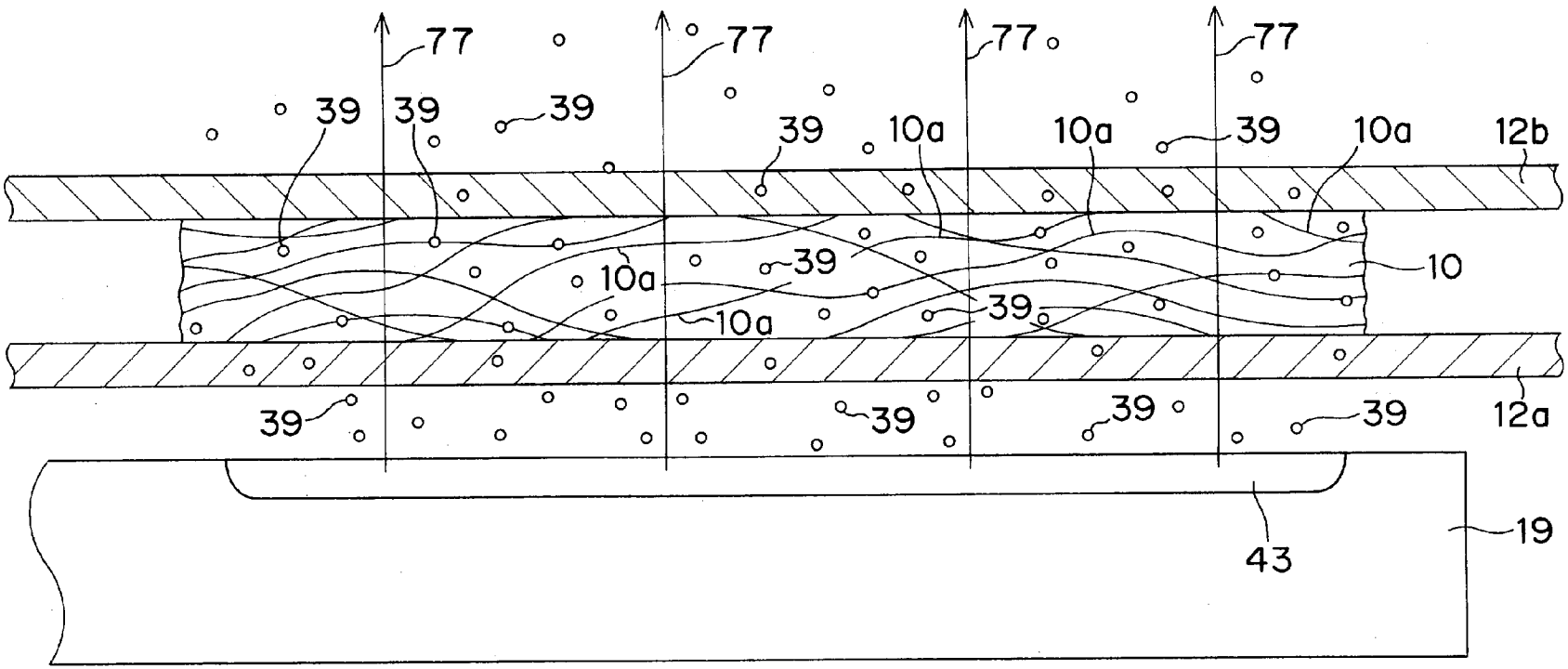
FIG. 11 is an explanatory view showing the movement of the ozone gas bubbles.

That is, referring to FIG. 11, the ozone gas bubbles 39 which have been discharged, or released, from the elongate hole 43 of the discharge nozzle 19, pass through a plurality of openings of the mesh belt 12*a* to reach the continuous web-like form 10 of the wool fibers. The continuous web form 10 of the wool fibers has gaps, or spaces, among the respective fibers 10*a* thereof. The size of the gaps, or spaces, is very small. Therefore, preferably, the size of the ozone gas bubbles 39 is 50 microns or less, and more preferably, the size thereof is 30 microns or less. In other words, if the size of the ozone gas bubbles discharged is larger, the ozone gas finds difficulty in entering the inside of the continuous web-like form thereof.

As shown by arrows 77 in the figure, the suction ports 15 (i.e. 15*a* and 15*b*) and 16 (i.e. 16*a* and 16*b*) suck in the aqueous treatment liquid which has been discharged from the discharge nozzles 19, so that the aqueous treatment liquid including the ozone gas bubbles 39 moves, or passes, through the gaps or spaces among the respective wool fibers 10*a*. During this movement, the ozone gas comes into contact with the surfaces of the individual wool fibers 10*a*; the surfaces of the wool fibers 10*a* are allowed to react with the ozone gas; and the surfaces thereof are chemically modified. The ozone gas bubbles 39 and the aqueous treatment liquid which have reached the opposite surface of the wool fibers of the continuous web form 10, are sucked by the suction ports 15 and 16, and these bubbles 39 and liquid are guided to the gas-liquid mixing pumps 13 (i.e. 13*a*, 13*b*, 13*c* and 13*d*) for circulation.

As shown in FIG. 6, and as aforementioned, there are provided a pair of the circulation pumps 17, 17 in the treatment apparatus. Namely, one of the circulation pumps 17, 17 is connected to the suction ports 15*a*, 15*b* and 15*c* mounted on the side of the descending portion 11*a*; and the other of the circulation pumps 17, 17 is connected to the suction ports 16*a*, 16*b* and 16*c* mounted on the side of the ascending portion 11*b*, respectively. With the arrangement, the force to suction the aqueous treatment liquid including the ozone gas bubbles in the circulation system, is enhanced. The aqueous treatment liquid which has been supplied to the circulation pump 17 through the pipe 24, as shown by an arrow 73 in FIG. 6, is sent back into the tank 11 through the pipe 22 (refer to FIG. 2), as described above. As shown in the same figure, the pipe 22 is provided with a heat exchanger 25 for regulating, or adjusting, the temperature of the aqueous treatment liquid contained in the tank 11, thereby realizing a suitable temperature thereof for the ozone treatment (about 20° C. to 60° C.) of the wool fibers 10.

As described above, according to the arrangement of the treatment apparatus installed in the wool fiber treatment system, fine bubbles of the ozone gas are continuously blown, or jetted, to the wool fibers of the continuous web form from one side of the continuous web form thereof, and at the same time, the aqueous treatment liquid including the ozone gas is continuously sucked from the other side of the continuous web form thereof, thereby making the ozone gas reach up to the inside of the wool fibers of the continuous web form thereof.

Also, according to the arrangement thereof, the suction ports 15*a*, 15*b* and 15*c* which are mounted on the descending portion 11*a* of the tank 11, are positioned on one side of the wool fibers of the continuous web form 10; on the other hand, the suction ports 16*a*, 16*b* and 16*c* which are mounted on the ascending portion 11*b* of the tank 11, are positioned on the other side of the wool fibers of the continuous web form 10, thereby preventing, or suppressing, the unevenness of treatment of the wool fibers of the continuous web form 10 in the direction of thickness of the continuous web form 10 thereof.

Also, according to the arrangement thereof, the circulation pumps 17, 17 are connected to the suction ports 15 (i.e. 15*a*, 15*b*, 15*c*) and 16 (i.e. 16*a*, 16*b*, 16*c*), thereby enhancing the force to suck the ozone gas bubbles. This improves the efficiency of suction of the ozone gas.

A fresh liquid and ozone gas are always supplied into the circulation systems, and they are circulated therein. This prevents the ozone gas from being consumed due to reaction with the treatment liquid containing contamination coming off from the wool fibers, thus enabling supply of the ozone gas at a high concentration for reaction with the wool fibers of continuous web form.

Also, according to the arrangement thereof, the aqueous treatment liquid in the circulation systems can be maintained at a temperature at which dispersion of the ozone gas is facilitated, and at the same time, the conditions for the reaction in the tank can be easily adjusted by adjusting the conditions of the treatment liquid pumped out from the circulation pumps 17, 17.

Although the present invention has been fully described in connection with the preferred embodiment thereof with reference to the accompanying drawings, it is to be noted that various other changes and modifications are also apparent to those skilled in the art. Such changes and modifications are to be understood as included within the scope of the present invention as defined by the appended claims unless they depart therefrom.

What is claimed is:

1. A treatment apparatus for chemical modification of animal fibers of a continuous web form, comprising:

a tank filled with an aqueous treatment liquid;

a net coveyor which has a pair of mesh belts composed of an upper mesh belt and a lower mesh belt and which conveys the continuous web form through the aqueous treatment liquid in the tank, with the pair of mesh belts overlapping each other in a state in which the pair of mesh belts sandwich the continuous web form therebetween for holding the continuous web form;

a treatment liquid circulation system having:

a gas-liquid mixing pump which includes an inlet connected to a suction port provided in the tank and which includes an outlet for supplying the aqueous treatment liquid into the tank;

a static mixer which is connected downstream of the outlet of the gas-liquid mixing pump; and a discharge nozzle which is provided opposite the suction port in the tank with respect to the pair of mesh belts, in which the discharge nozzle is connected downstream of the static mixer; and an ozonizer for supplying ozone gas to the treatment liquid circulation system, wherein the animal fibers of the continuous web form are continuously treated with the ozone gas, by mixing the aqueous treatment liquid supplied from the gas-liquid mixing pump with the ozone gas supplied from the ozonizer by the static mixer into dispersing the ozone gas as fine gas bubbles thereof in the aqueous treatment liquid uniformly, by discharging the aqueous treatment liquid containing the fine gas bubbles thereof toward the pair of mesh belts from the discharge nozzle, and by sucking the aqueous treatment liquid containing the fine gas bubbles thereof from the suction port.

2. The treatment apparatus as claimed in claim 1, wherein there are provided a pair of treatment liquid circulation systems each of which is the treatment liquid circulation system, and wherein the discharge nozzle of one of the pair of treatment liquid circulation systems is provided on one of sides of the mesh belts, and the discharge nozzle of the other of the pair of treatment liquid circulation systems is provided on the other of sides of the mesh belts in which the discharge nozzle of the one thereof and the discharge nozzle of the other thereof are arranged at different locations with respect to a direction in which the animal fibers of the continuous web form are conveyed by the mesh belts.

3. The treatment apparatus as claimed in claim 1, wherein the tank comprises a generally V-shaped tubular body, having an inner space, that is generally rectangular in cross section, in which the inner space has a dimension allowing the pair of mesh belts to pass through therein, wherein the generally V-shaped tubular body comprises:

a descending part inside which the pair of mesh belts move down;

an ascending part inside which the pair of mesh belts move up; and a central lower part inside which the pair of mesh belts turn from the descending part to the ascending part, in which the descending part and the ascending part are connected by the central lower part.

4. The treatment apparatus as claimed in claim 1, wherein there is further provided a treatment liquid circulation system having a circulation pump which includes an inlet connected to the suction port in the tank and which includes an outlet for returning the aqueous treatment liquid into the tank.

5. The treatment apparatus as claimed in claim 1, wherein the ozone gas supplied from the ozonizer and a fresh liquid of the aqueous treatment liquid are supplied between the suction port of the tank and the inlet of the gasliquid mixing pump.

6. The treatment apparatus as claimed in claim 1, wherein there are provided a plurality of discharge nozzles each of which is the discharge nozzle, wherein the discharge nozzle has a predetermined length in a direction of width of the mesh belts, and wherein the plurality of discharge nozzles are provided in the direction of width thereof so that the plurality of discharge nozzles extend from both sides, in the direction of width, of the mesh belts toward a center of the mesh belts in the direction of width.

7. The treatment apparatus as claimed in claim 1, wherein each of the fine gas bubbles has a size of 50 microns or less.

* * * * *